US005890767A

United States Patent [19]

Chang

[11] Patent Number: 5,890,767

[45] Date of Patent: Apr. 6, 1999

[54] MODULAR SOFA

[76] Inventor: Yuan-Feng Chang, No. 34, Chung-Cheng Rd., Chu-Chi Tsun, Chu-Chi Hsiang, Chia-I Hsien, Taiwan

[21] Appl. No.: 953,839

[22] Filed: Oct. 14, 1997

[51] Int. Cl.[6] ..... A47C 7/00

[52] U.S. Cl. ..... 297/440.14; 297/248; 297/440.15; 297/440.22; 297/440.23

[58] Field of Search ..... 297/440.14, 440.15, 297/440.22, 440.23, 248, 451.8

[56] References Cited

U.S. PATENT DOCUMENTS

| | | | |
|---|---|---|---|
| 2,597,860 | 5/1952 | Gerber et al. | 297/440.23 X |
| 3,608,959 | 9/1971 | Sarvas | 297/440.15 X |
| 4,043,591 | 8/1977 | Lehmann | 297/440.14 X |
| 4,077,666 | 3/1978 | Heumann | 297/440.14 |
| 4,311,337 | 1/1982 | Brunn | 297/440.15 X |
| 5,080,438 | 1/1992 | Moyer | 297/440.23 |
| 5,678,897 | 10/1997 | Prestia | 297/440.23 X |

*Primary Examiner*—Jose V. Chen
*Assistant Examiner*—Stephen Vu
*Attorney, Agent, or Firm*—Leydig, Voit & Mayer, Ltd.

[57] ABSTRACT

A modular sofa includes a hollow frame, an upholstered back frame, at least one first fastener, a pair of upholstered armrest frames, at least one second fastener and an upholstered seat frame. The hollow frame has front and back walls and a parallel pair of side walls interconnecting the front and back walls. The upholstered back frame has a lower end portion to be detachably fastened to the back wall. The first fastener fastens the upholstered back frame to the back wall of the hollow frame. The pair of upholstered armrest frames are to be detachably fastened to the side walls, respectively. The second fastener fastens each of the upholstered frames to a respective one of the side walls. The upholstered seat frame is detachably mounted to the top of the hollow frame.

8 Claims, 5 Drawing Sheets

MODULAR SOFA

BACKGROUND OF THE INVENTION

1. Field of the Invention

The present invention relates to a modular sofa, more particularly to a modular sofa which includes a seat frame, a back frame, and armrest frames all of which can be attached easily to a four-sided hollow frame after they are upholstered.

2. Description of the Related Art

A conventional sofa, for example, a one-seater, a two-seater or a three-seater sofa, generally has a fixed numbers of seat(s). In the manufacture of conventional sofa, a sofa frame with a predetermined specification that is designed for a predetermined number of seat(s) is constructed and then upholstered to result in a finished sofa. The sofa is then transported to a predetermined place for storage or for sale. However, the constructed and finished sofa usually occupies a relatively large space and is thus not convenient in transport or storage. Moreover, the conventional sofa cannot be re-arranged to vary the number of seats to suit a user's requirements. The conventional sofa with a fixed number of seat(s) is thus not satisfactory.

SUMMARY OF THE INVENTION

The main object of the present invention is to provide a modular sofa that can be conveniently assembled by uniting upholstered components.

Another object of the present invention is to provide upholstered sofa components that can be combined to form different sofa assemblies having varying numbers of seats.

Accordingly the modular sofa of the present invention includes a hollow frame, an upholstered back frame, at least one first fastener, a pair of upholstered armrest frames, at least one second fastener and an upholstered seat frame. The hollow frame has front and back walls and a parallel pair of side walls interconnecting the front and back walls. The upholstered back frame has a lower end portion to be detachably fastened to the back wall. The first fastener fastens the upholstered back frame to the back wall of the hollow frame. The pair of upholstered armrest frames are to be detachably fastened to the side walls respectively. The second fastener fastens each of the upholstered frames to a respective one of the side walls. The upholstered seat frame is detachably mounted to the top of the hollow frame.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENTS

Figure 1:
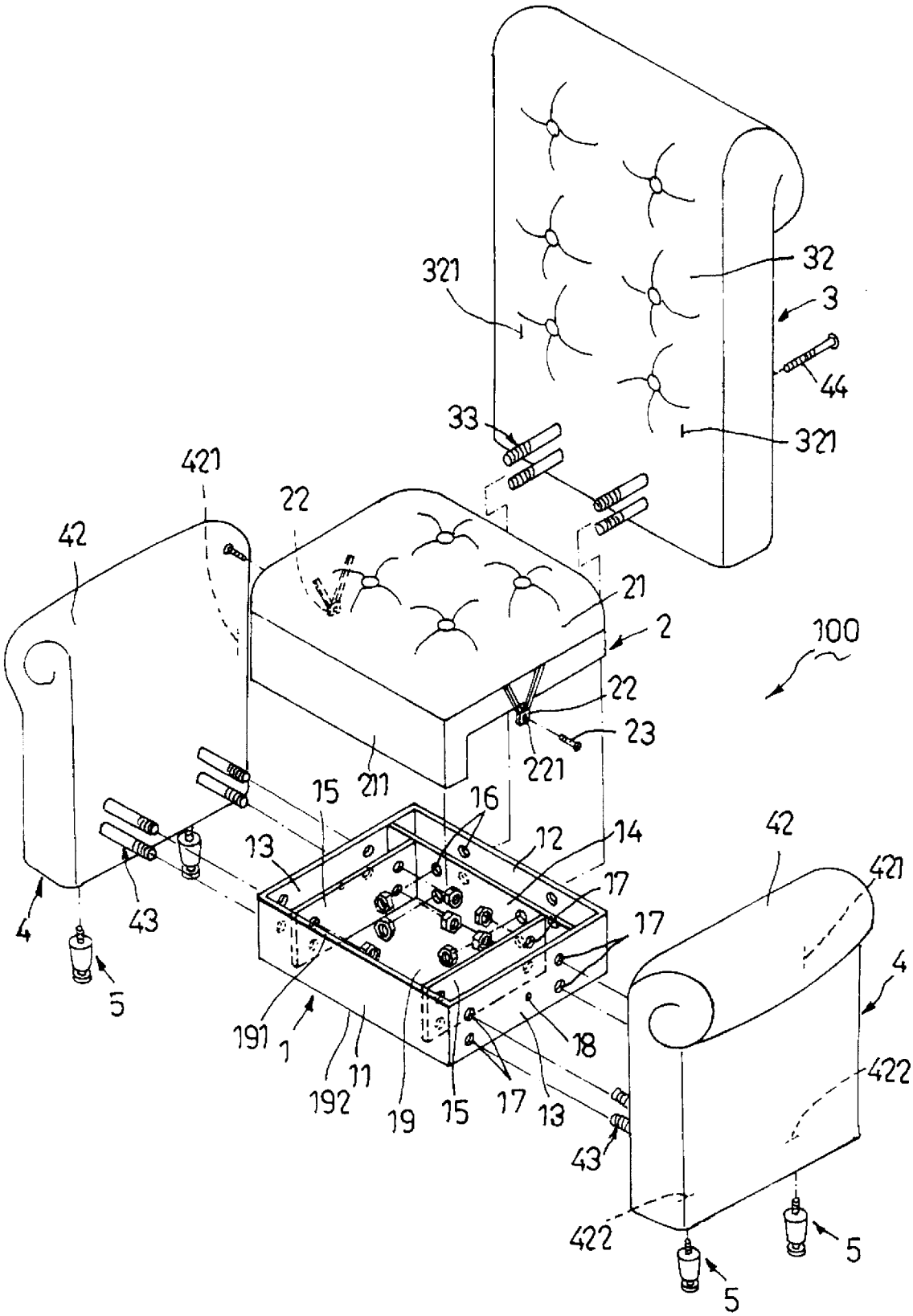
FIG. 1 is an exploded perspective view of a modular sofa according to a first preferred embodiment of the present invention.

Before the present invention is described in greater detail, it should be noted that like elements are indicated by the same reference numerals throughout the disclosure.

Figure 2:
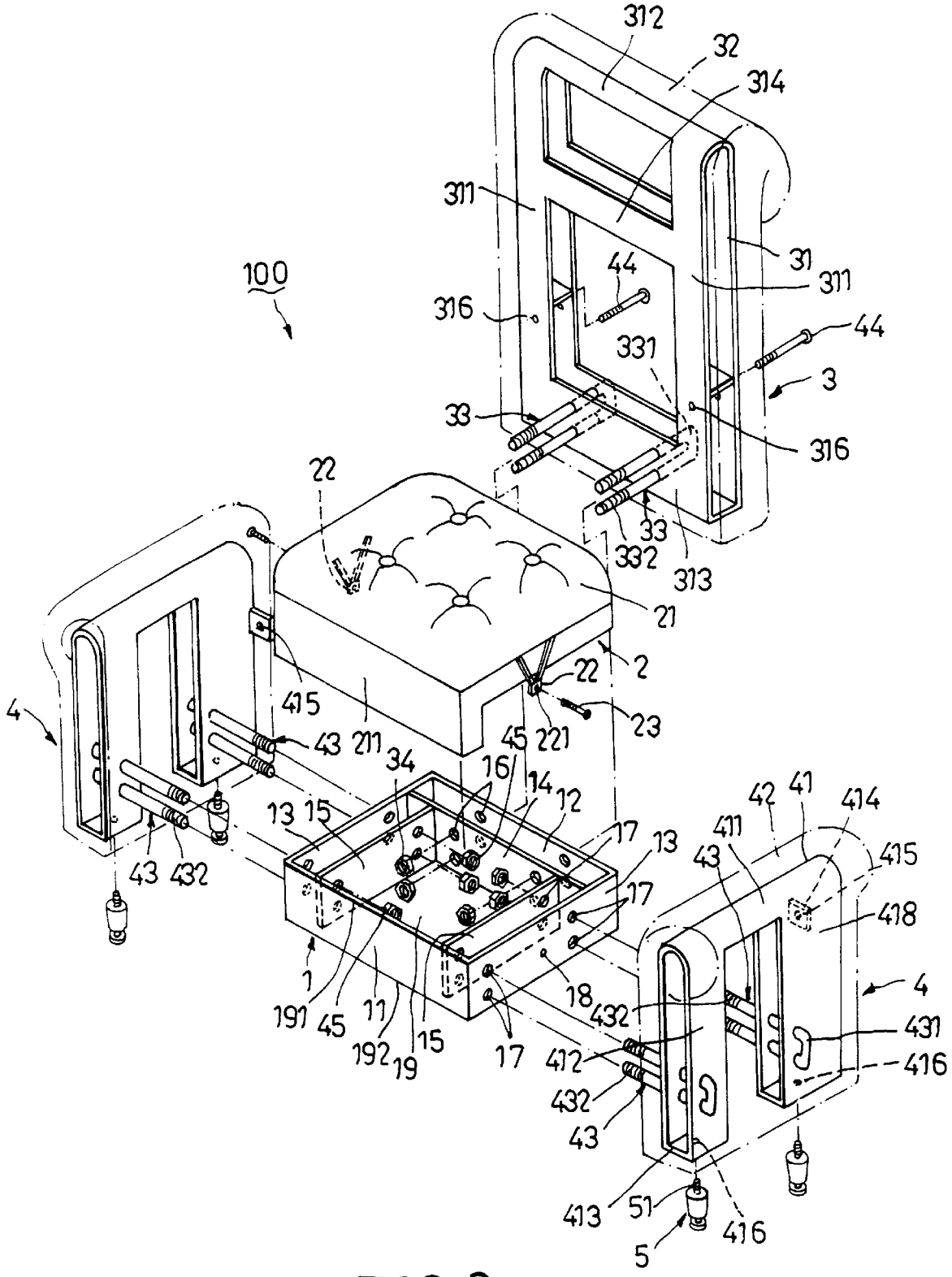
FIG. 2 is an exploded perspective view of the modular sofa of the first preferred embodiment where upholsters on the back frame and armrest frames are indicated by phantom lines.

Referring to FIGS. 1 and 2, a one-seater modular sofa 100 according to a first preferred embodiment of the present invention is shown to include a rectangular hollow frame 1, an upholstered back frame 3, a pair of armrest frames 4 and an upholstered seat frame 2.

The hollow frame 1 is made of extruded aluminum and has front and back walls 11, 12 and a pair of side walls 13 interconnecting the front and back walls 11, 12. An inner frame which includes a rear reinforcing wall 14 and a parallel pair of lateral reinforcing walls 15 perpendicular to the rear reinforcing wall 14 are disposed fixedly within the hollow frame 1. The rear reinforcing wall 14 is parallel and adjacent to the back wall 12. The pair of lateral reinforcing walls 15 are parallel and adjacent to the side walls 13, respectively. Four first fastener holes 16 are formed through the back wall 12 and the rear reinforcing wall 14. Four second fastener holes 17 are formed through each of the side walls 13 and an adjacent one of the lateral reinforcing walls 15. Each of the side walls 13 is further formed with a positioning hole 18. The hollow frame 1 has a top side and a bottom side, each of which is formed with an access opening 191, 192 for access to a space 19 confined by the front, back and side walls, 11, 12, 13 and by the rear and lateral reinforcing walls 14, 15.

The upholstered seat frame 2 is mounted detachably to the top of the hollow frame 1. The seat frame 2 has a horizontal portion which is provided with a chair cushion 21 thereon and which covers a top side of the hollow frame 1 when mounted on the hollow frame 1. The seat frame 2 is provided with a pair of downward lobes 22 which extend downwardly from two opposite sides thereof and which are formed with a mounting hole 221 to be aligned with the positioning hole 18 in a respective one of the side walls 13 of the hollow frame 1. A screw member 23 extends through the mounting hole 221 and the respective positioning hole 18 for mounting detachably the upholstered seat frame 2 to the hollow frame 1. The seat frame 2 further has a vertically extending portion 211 which extends downwardly from a front edge thereof to cover a front side of the hollow frame 1.

The upholstered back frame 3 includes an interior back frame 31 that is formed by bending and punching a metal plate, and a back upholster 32 enclosing the interior back frame 31. The interior back frame 31 has a width substantially equal to that of the hollow frame 1 and includes a pair of vertical lateral portions 311 which are connected to one another by means of an upper connecting portion 312 at an upper end portion of the interior back frame 31 and a lower connecting portion 313 at a lower end portion of the interior back frame 31. A middle connecting portion 314 is formed between the upper and lower connecting portions 312, 313 to reinforce the connection of the lateral portions 311. Each of the lateral portions 311 is formed with a third fastener hole 316. The back upholster 32 is formed with two slits 321 aligned with the third fastener holes 316, respectively.

The modular sofa 100 further includes a pair of first fasteners 33, each of which includes a U-shaped rod having a bent portion 331 and two parallel screw rods 332 which extend forwardly through the lower connecting portion 313 of the interior back frame 31 and out of the back upholster 32 for extension into the space 19 of the hollow frame 1 via the first fastener holes 16 formed through the back wall 12 and the rear reinforcing wall 14 of the hollow frame 1. Nuts 34 are threadedly sleeved onto the screw rods 332, respectively, thereby fastening the back frame 3 to the back wall 12.

Each of the upholstered armrest frames 4 is to be fastened to one of the side walls 13 of the hollow frame 1 and includes an interior armrest frame 41 and an armrest upholster 42 enclosing the interior armrest frame 41. The interior armrest frame 41 is formed by cutting and bending a metal plate and includes a horizontal upper portion 411 and front and rear vertical portions 412, 418 extending downwardly from the horizontal upper portion 411. Each of the vertical portions 412, 418 has a lower end with an end face 413 formed with a threaded hole 416. The armrest upholster 42 has a lower end face formed with two slits 422 aligned with the threaded holes 416. The rear vertical portion 418 is formed with an inward lobe 414 which protrudes inwardly toward the hollow frame 1 and which is formed with a threaded hole 415. The inward lobe 414 is enclosed by the armrest upholster 42 which has a rear end face facing the upholstered back frame 3 and formed with a slit 421 that is aligned with the threaded hole 415. The threaded hole 415 and the slit 421 of each of the upholstered armrest frames 4 are to be aligned with one of the slits 321 and one of the third fastener holes 316 in the upholstered back frame 3, respectively.

The modular sofa 100 further includes two pairs of foot members 5 each of which has an upper threaded rod portion 51 extending through a respective one of the slits 422 to engage a respective one of the threaded holes 416 in order to mount the foot members 5 removably to a lower end of the upholstered armrest frames 4.

The modular sofa 100 further includes a pair of second fasteners 43 in the form of a U-shaped rod, which are fixed to the front and rear vertical portions 412, 418 of the interior armrest frame 41. The U-shaped rod has a bent portion 431 and two parallel screw rods 432 which extend inwardly through the interior armrest frame 41 and out of the armrest upholster 42. Each of the screw rods 432 has an axis aligned with a respective one of the second fastener holes 17 formed through the side walls 13 and the lateral reinforcing walls 15 of the hollow frame 1. Each of the second fasteners 43 further includes two nuts 45. The screw rods 432 of the second fasteners 43 extend into the space 19 through the second fastener holes 17 and are coupled with the nuts 45, thereby fastening detachably the upholstered armrest frames 4 to the hollow frame 1.

The modular sofa 100 further includes a pair of third fasteners 44, each of which has a screw rod extending from a rear side of the interior back frame 31 through an aligned set of the third fastener hole 316, the slit 321 and the slit 421 to engage a corresponding one of the threaded holes 415, thereby fastening the upholstered armrest frames 4 to the upholstered back frame 3 and reinforcing the construction of the modular sofa 100.

It should be noted that the back upholster 32 encloses the interior back frame 31 whilst permitting extension of the screw rods 332 of the first fasteners 33 out of the back upholster 32. Likewise, in each of the upholstered armrest frames 4, the armrest upholster 42 encloses the interior armrest frame 41 and the inward lobe 414 whilst permitting extension of the screw rods 432 of the second fasteners 43 out of the armrest upholster 42. The first and second fasteners 33, 43 are respectively attached to the interior back frame 31 and the interior armrest frames 41 before the interior frames 31, 41 are upholstered. The upholstered components of the modular sofa 100 can then be transported to a store room of a retailer and to be assembled thereat in a relatively convenient manner. Since the hollow frame 1 is formed with access openings 191, 192 for access to the space 19, the nuts 34, 45 and the screw rods 332, 432 can be easily coupled together within the space 19 via the access opening 191 or 192.

Figure 3:
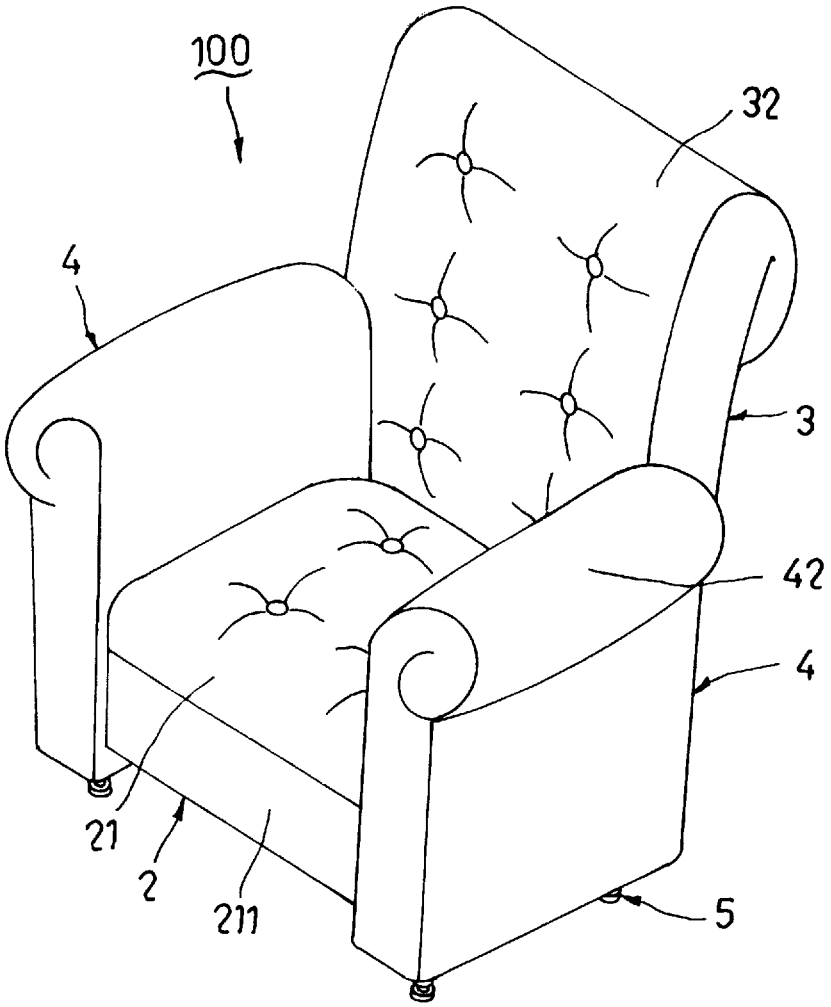
FIG. 3 is a perspective view of the modular sofa of the first preferred embodiment after assembly.

FIG. 3 illustrate the modular sofa 100 after being assembled. The modular sofa 100 has a single seat.

Figure 4:
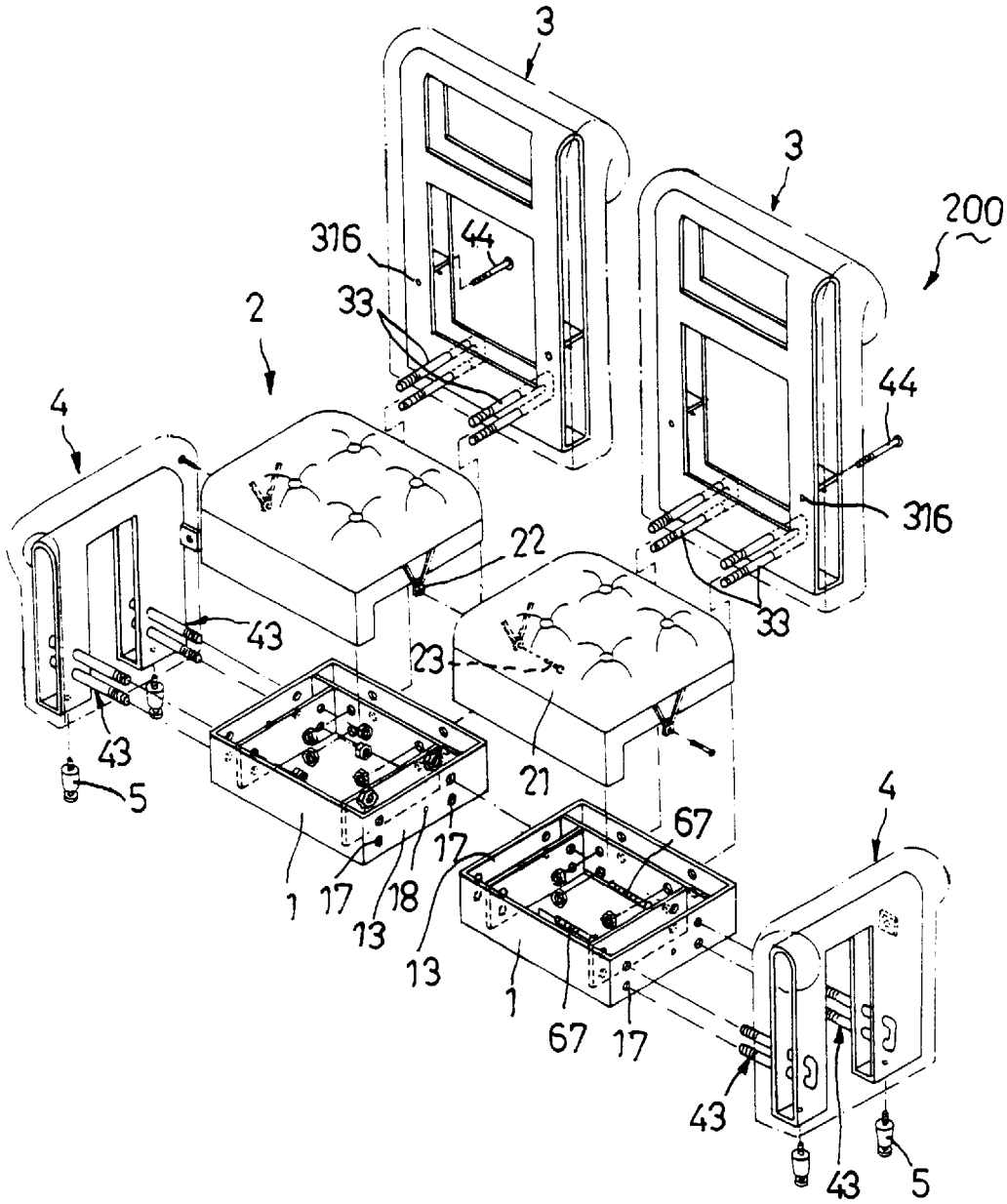
FIG. 4 is an exploded perspective view of a modular sofa according to a second preferred embodiment of the present invention where upholsters on the back frames and armrest frames are indicated by phantom lines.
Figure 5:
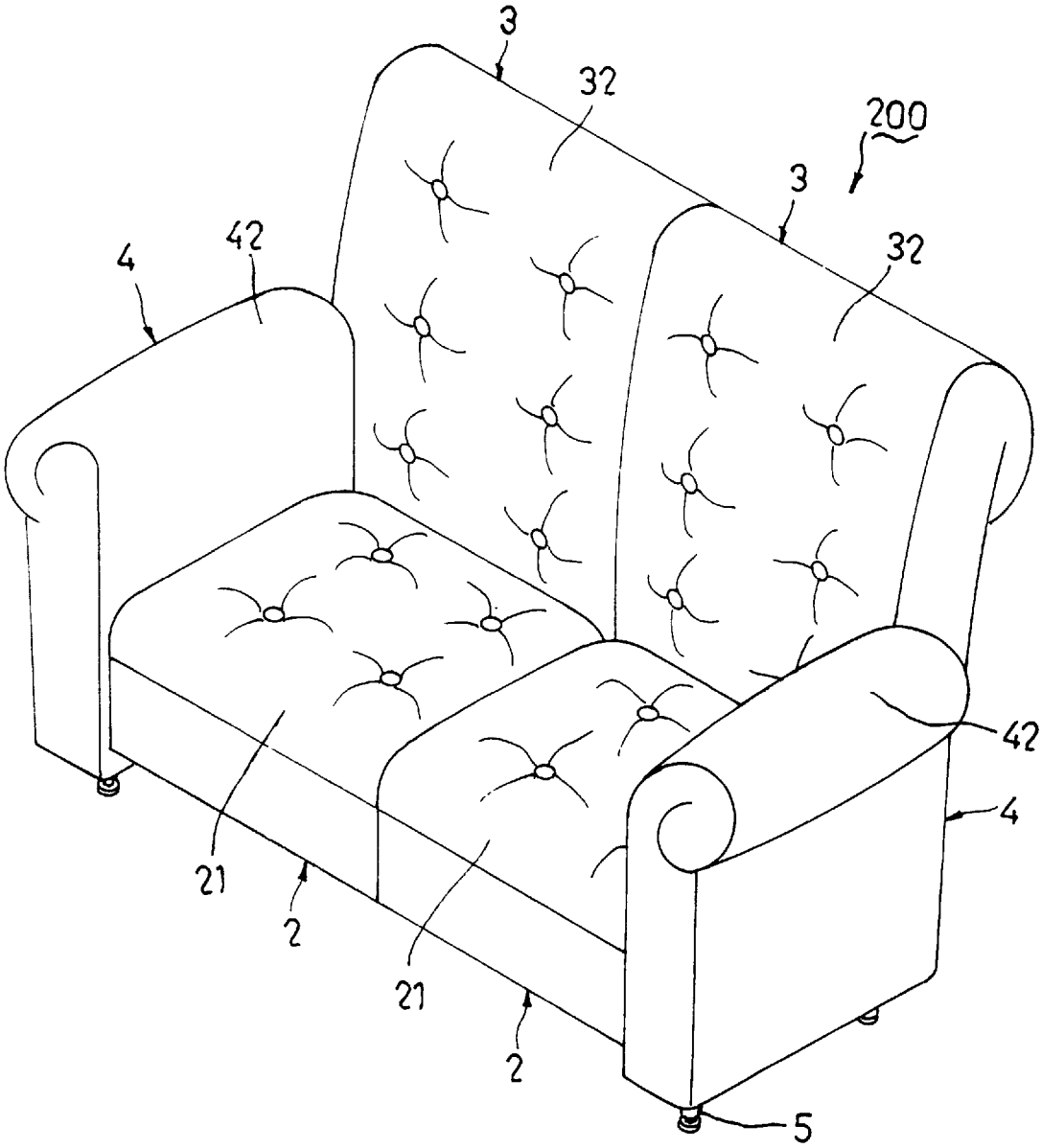
FIG. 5 is a perspective view of the modular sofa of the second preferred embodiment after assembly.

Referring to FIGS. 4 and 5, a two-seater modular sofa 200 according to a second preferred embodiment is shown to include two side-by-side disposed rectangular hollow frames 1, two upholstered back frames 3, a pair of armrest frames 4 which are respectively fastened to the left side wall 13 of the left hollow frame 1 and the right side wall 13 of the right hollow frame 1, and two upholstered seat frames 2.

In assembly, the second embodiment differs from the first embodiment in that, after two hollow frames 1 are disposed side by side, a screw 23 is threaded through the downward lobe 22 of one of the seat frames 2 and the positioning hole 18 of one of the hollow frames 1, and is passed through the downward lobe of another seat frame 2 and the positioning hole 18 of another hollow frame 1. In addition, screws 67 are used to fasten the adjacent side walls 13 of the two hollow frames 1. By employing the assembling method of the second embodiment, a sofa with more than two seats can be assembled.

With this invention thus explained, it is apparent that numerous modifications and variations can be made without departing from the scope and spirit of this invention. It is therefore intended that this invention be limited only as indicated in the appended claims.

I claim:

1. A modular sofa comprising:

a hollow frame having front and back walls and a pair of parallel side walls interconnecting said front and back walls;

an upholstered back frame having a lower end portion detachably fastened to said back wall;

at least a first fastener to fasten said upholstered back frame to said back wall of said hollow frame;

a pair of upholstered armrest frames detachably fastened to said side walls, respectively;

at least a second fastener for fastening each of said upholstered armrest frames to a respective one of said side walls;

an upholstered seat frame detachably mounted to the top of said hollow frame;

an inner frame disposed within said hollow frame, said inner frame including reinforcing walls which are parallel and adjacent to said back wall and said side walls, respectively, said fastener passing through a respective fastener hole in said back wall and said side walls and a respective one of said reinforcing walls; and said hollow frame has an access opening formed on at least a top side and a bottom side of said hollow frame for access to a space confined by said front, back and side walls, said first and second fasteners passing through said back and side walls, respectively, and extending into said space, thereby permitting said first and second fasteners to be operated via said access opening.

2. The modular sofa according to claim 1, wherein each of said first and second fasteners includes a screw rod fixed to a respective one of said upholstered back frame and said upholstered armrest frame, and a nut to be coupled with said screw rod, said hollow frame being provided with fastener holes in said back wall and side walls for passage of said first and second fasteners, respectively.

3. The modular sofa according to claim 1, further comprising third fasteners for fastening said upholstered armrest frames to said upholstered back frame.

4. The modular sofa according to claim 3, wherein each of said third fasteners includes a screw rod extending from said upholstered back frames, said upholstered armrest frames being formed with a threaded hole for engaging said screw rod.

5. The modular sofa according to claim 1, wherein said upholstered seat frame has a horizontal portion which covers the top side of said hollow frame and a downwardly extending portion which covers the front side of said hollow frame.

6. The modular sofa according to claim 1, wherein each of said upholstered armrest frames has a lower end provided with a removable foot member.

7. A modular sofa comprising:

at least two hollow frames disposed side by side, each of said hollow frames having a top, front and back walls and a parallel pair of side walls interconnecting said front and back walls;

at least two upholstered back frames disposed side by side and detachably fastened to said back walls of said hollow frames, respectively;

first fastener means for fastening each of said upholstered back frames to a respective one of said back walls of said hollow frames;

a pair of upholstered armrest frames, one of said upholstered armrest frames being detachably fastened to one of said side walls of one of said hollow frames, the other one of said upholstered armrest frames being detachably fastened to one of said side walls of the other one of said hollow frames;

second fastener means for fastening each of said upholstered armrest frames to a respective one of said side walls;

at least two upholstered seat frames mounted detachably and respectively to the tops of said hollow frames; and an inner frame disposed within said hollow frame, said inner frame including reinforcing walls which are parallel and adjacent to said back wall and said side walls, respectively, said fastener passing through a respective fastener hole in said back wall and said side walls and a respective one of said reinforcing walls.

8. The modular sofa according to claim 7, further comprising a fastener for fastening said hollow frames to one another.

* * * * *